US008869315B2

(12) United States Patent
Contant et al.

(10) Patent No.: US 8,869,315 B2
(45) Date of Patent: Oct. 28, 2014

(54) PROTECTIVE ATHLETIC GARMENT

(75) Inventors: Mathieu Contant, Verdun (CA); Marco Beauregard, Morin Heights (CA); Marie-Claude Généreux, Saint-Thèrése (CA); Alexandre Leblanc, Montreal (CA)

(73) Assignee: Bauer Hockey, Inc., Exeter, NH (US)

( * ) Notice: Subject to any disclaimer, the term of this patent is extended or adjusted under 35 U.S.C. 154(b) by 29 days.

(21) Appl. No.: 13/475,441

(22) Filed: May 18, 2012

(65) Prior Publication Data

US 2013/0305439 A1 Nov. 21, 2013

(51) Int. Cl.

| | |
|---|---|
| ***A41D 27/26*** | (2006.01) |
| ***A41D 27/12*** | (2006.01) |
| *A41D 27/00* | (2006.01) |

(52) U.S. Cl.

USPC ..... 2/459; 2/44; 2/45; 2/69; 2/267; 2/94

(58) Field of Classification Search

None

See application file for complete search history.

(56) References Cited

U.S. PATENT DOCUMENTS

| | | | | | |
|---|---|---|---|---|---|
| 1,806,909 | A | * | 5/1931 | Meyer | 2/326 |
| 2,436,054 | A | * | 2/1948 | Lotte Pinkas | 2/268 |
| 3,594,874 | A | * | 7/1971 | Fujisaki | 24/394 |
| 3,687,143 | A | * | 8/1972 | Schneeberger et al. | 602/2 |
| 3,740,763 | A | * | 6/1973 | Mitchell | 2/462 |
| 3,867,726 | A | * | 2/1975 | Owl et al. | 2/462 |
| 3,940,917 | A | * | 3/1976 | Strachan | 57/207 |
| 4,127,268 | A | * | 11/1978 | Lindgren | 473/576 |
| 4,135,252 | A | * | 1/1979 | Latina et al. | 2/462 |
| 4,158,242 | A | * | 6/1979 | Mitchell | 2/462 |
| 4,159,010 | A | * | 6/1979 | Mitro | 5/89.1 |
| 4,295,227 | A | * | 10/1981 | Mitchell | 2/462 |
| 4,320,537 | A | * | 3/1982 | Mitchell | 2/462 |
| 4,322,859 | A | * | 4/1982 | Mitchell | 2/462 |
| 4,435,851 | A | * | 3/1984 | Mitchell et al. | 2/462 |
| 4,467,475 | A | * | 8/1984 | Gregory et al. | 2/462 |
| 4,590,622 | A | * | 5/1986 | Wolfe et al. | 2/462 |
| 4,674,157 | A | | 6/1987 | Litz | |
| 4,680,814 | A | * | 7/1987 | Mitchell et al. | 2/462 |
| 4,698,845 | A | | 10/1987 | Cosby | |
| 4,698,846 | A | * | 10/1987 | Wang | 2/462 |
| 4,715,066 | A | * | 12/1987 | Mitchell et al. | 2/462 |
| 4,868,925 | A | * | 9/1989 | Mitchell | 2/462 |
| 4,872,216 | A | * | 10/1989 | Wingo, Jr. | 2/462 |
| 4,989,265 | A | * | 2/1991 | Nipper et al. | 2/462 |
| 5,029,341 | A | * | 7/1991 | Wingo, Jr. | 2/462 |
| 5,060,313 | A | * | 10/1991 | Neuhalfen | 2/462 |
| 5,060,314 | A | * | 10/1991 | Lewis | 2/2.5 |
| 5,063,941 | A | * | 11/1991 | White | 128/869 |

(Continued)

*Primary Examiner* — Bobby Muromoto, Jr.

(57) ABSTRACT

A protective athletic garment comprising a protective cap for protecting a body part of the user. The protective cap comprises a shell for overlying the user's body part. The shell comprises a first shell member and a second shell member. The protective cap comprises a liner mounted under the shell for being disposed between the shell and the user's body part. The protective cap also comprises a link interconnecting the first shell member and the second shell member to hold the first shell member and the second shell member together. The link extends along at least part of a periphery of the first shell member and at least part of a periphery of the second shell member such that the first shell member and the second shell member are movable relative to one another in response to movement of the user's body part.

34 Claims, 8 Drawing Sheets

(56) References Cited

U.S. PATENT DOCUMENTS

| | | | | |
|---|---|---|---|---|
| 5,146,621 | A * | 9/1992 | Hadar et al. | 2/462 |
| 5,159,715 | A * | 11/1992 | Jurga et al. | 2/462 |
| 5,173,964 | A * | 12/1992 | Ball et al. | 2/461 |
| 5,742,938 | A | 4/1998 | Winningham et al. | |
| 5,749,326 | A * | 5/1998 | Jones et al. | 119/798 |
| 6,272,888 | B1 * | 8/2001 | Fujita et al. | 66/172 E |
| 6,286,341 | B2 * | 9/2001 | Jackson et al. | 66/83 |
| 6,654,961 | B2 | 12/2003 | Beland | |
| 6,687,912 | B2 | 2/2004 | Collins et al. | |
| 6,845,522 | B2 * | 1/2005 | Beland | 2/461 |
| D553,299 | S * | 10/2007 | Le Carpentier | D29/101.2 |
| 7,647,651 | B2 * | 1/2010 | Contant et al. | 2/459 |
| 7,730,549 | B2 * | 6/2010 | Morrow et al. | 2/16 |
| 7,765,624 | B1 * | 8/2010 | Larson et al. | 2/459 |
| 7,797,760 | B2 | 9/2010 | Morrow et al. | |
| 7,797,764 | B2 | 9/2010 | Norris | |
| 7,827,625 | B2 * | 11/2010 | Morrow et al. | 2/463 |
| 7,832,017 | B2 | 11/2010 | Nascimento et al. | |
| 7,845,017 | B2 | 12/2010 | Godshaw et al. | |
| 7,854,026 | B2 * | 12/2010 | Phaneuf et al. | 2/461 |
| 7,874,022 | B2 * | 1/2011 | McQueer | 2/461 |
| 7,895,673 | B2 * | 3/2011 | Forselius et al. | 2/237 |
| 8,062,446 | B1 * | 11/2011 | Beauregard et al. | 156/93 |
| 8,191,174 | B2 * | 6/2012 | Winningham et al. | 2/161.1 |
| 2001/0034505 | A1 * | 10/2001 | Wilke | 604/179 |
| 2003/0066116 | A1 * | 4/2003 | Graves et al. | 2/2.5 |
| 2003/0079277 | A1 * | 5/2003 | Gillen et al. | 2/268 |
| 2004/0003448 | A1 * | 1/2004 | Morrow et al. | 2/92 |
| 2004/0128748 | A1 * | 7/2004 | Monica | 2/462 |
| 2004/0205881 | A1 * | 10/2004 | Morrow et al. | 2/459 |
| 2004/0210992 | A1 * | 10/2004 | Morrow et al. | 2/455 |
| 2005/0086728 | A1 * | 4/2005 | Tobergte | 2/459 |
| 2006/0053535 | A1 * | 3/2006 | Ide et al. | 2/459 |
| 2007/0033709 | A1 * | 2/2007 | Forselius et al. | 2/237 |
| 2007/0050884 | A1 * | 3/2007 | Contant et al. | 2/92 |
| 2008/0040840 | A1 * | 2/2008 | Morrow et al. | 2/462 |
| 2008/0092281 | A1 * | 4/2008 | Morrow et al. | 2/461 |
| 2009/0172869 | A1 * | 7/2009 | Ide et al. | 2/462 |
| 2010/0037374 | A1 * | 2/2010 | Crelinsten et al. | 2/455 |
| 2010/0192287 | A1 * | 8/2010 | Kraemer et al. | 2/459 |
| 2011/0072564 | A1 * | 3/2011 | Krauter | 2/422 |
| 2012/0060268 | A1 * | 3/2012 | Crelinsten et al. | 2/463 |
| 2012/0311773 | A1 * | 12/2012 | Anderson | 2/431 |
| 2013/0000023 | A1 * | 1/2013 | Kraemer et al. | 2/459 |
| 2013/0014318 | A1 * | 1/2013 | Jourde et al. | 2/459 |
| 2013/0079201 | A1 * | 3/2013 | Morgan | 482/124 |

* cited by examiner

PROTECTIVE ATHLETIC GARMENT

FIELD OF THE INVENTION

The invention relates generally to protective athletic equipment and, more particularly, to protective caps of protective athletic garments such as shoulder pads, elbow pads, and leg pads.

BACKGROUND

Shoulder pads are worn by players of contact sports, such as hockey, lacrosse and football, for upper body protection. The shoulder pads typically comprise front and back portions for respectively protecting front and back regions of a player's thorax and left and right shoulder protectors for respectively protecting the player's left and right shoulders.

Each shoulder protector usually comprises a protective cap, referred to as a "shoulder cap", which includes a shell of rigid material (e.g., polycarbonate or other rigid plastic) for protecting at least part of the player's shoulder. While the shell's rigidity can improve protection of the player's shoulder, it can often restrict or otherwise adversely affect freedom of movement of the player's shoulder. For instance, the shell of the shoulder cap normally overlies an acromioclavicular joint region of the player's shoulder and its rigidity can impede movement at this joint region as the player's moves his/her arm.

Similar issues can be encountered with protective caps of various other types of protective athletic garments, such as leg pads and elbow pads, worn by individuals involved in athletic activities to protect their body.

For these and other reasons, there is a need for improvements in protective caps of protective athletic garments.

SUMMARY OF THE INVENTION

According to an aspect of the invention, there is provided a protective athletic garment wearable by a user. The protective athletic garment comprises a protective cap for protecting a body part of the user. The protective cap comprises a shell for overlying the user's body part. The shell comprises a first shell member and a second shell member. The protective cap comprises a liner mounted under the shell for being disposed between the shell and the user's body part. The protective cap also comprises a link interconnecting the first shell member and the second shell member to hold the first shell member and the second shell member together. The link extends along at least part of a periphery of the first shell member and at least part of a periphery of the second shell member such that the first shell member and the second shell member are movable relative to one another in response to movement of the user's body part.

According to another aspect of the invention, there is provided a protective athletic garment wearable by a user. The protective athletic garment comprises a protective cap for protecting a body part of the user. The protective cap comprises a shell for overlying the user's body part. The shell comprises a first shell member and a second shell member. The protective cap comprises a liner mounted under the shell for being disposed between the shell and the user's body part. The protective cap also comprises a link interconnecting the first shell member and the second shell member to hold the first shell member and the second shell member together. The link extends along at least part of a periphery of the first shell member and at least part of a periphery of the second shell member such that the first shell member and the second shell member are movable relative to one another in response to movement of the user's body part. The shell and the liner are connected to one another through the link.

According to another aspect of the invention, there is provided a protective athletic garment wearable by a user. The protective athletic garment comprises a protective cap for protecting a body part of the user. The protective cap comprises a shell for overlying the user's body part. The shell comprises a first shell member and a second shell member. The protective cap comprises a liner mounted under the shell for being disposed between the shell and the user's body part. The protective cap also comprises a braiding interconnecting the first shell member and the second shell member to hold the first shell member and the second shell member together. The braiding extends along at least part of a periphery of the first shell member and at least part of a periphery of the second shell member such that the first shell member and the second shell member are movable relative to one another in response to movement of the user's body part.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the accompanying drawings, in which.

It is to be expressly understood that the description and drawings are only for the purpose of illustrating certain embodiments of the invention and are an aid for understanding. They are not intended to be a definition of the limits of the invention.

DETAILED DESCRIPTION OF EMBODIMENTS

Figure 1:
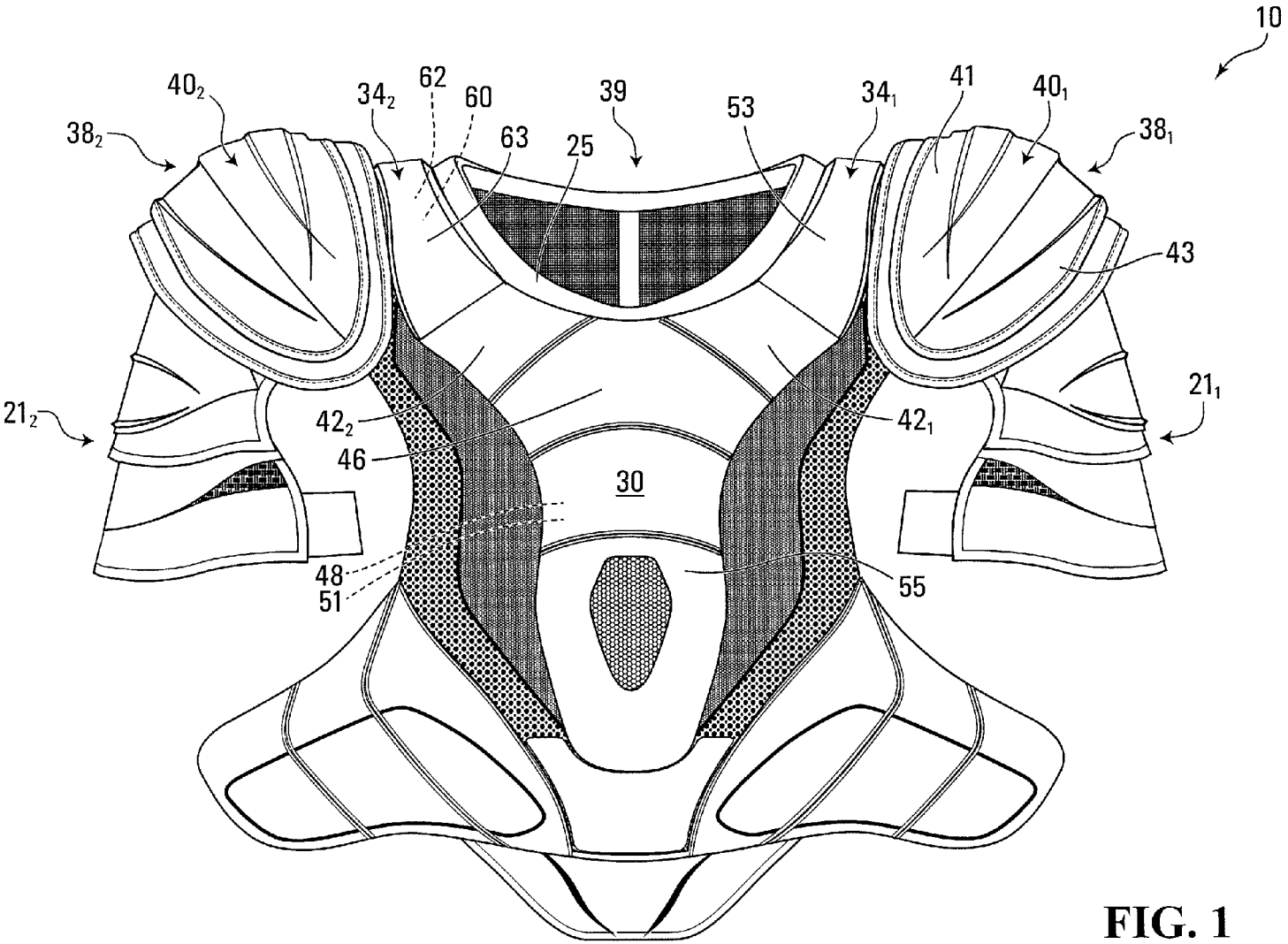
FIG. 1 shows a front view of an example of shoulder pads for upper body protection of a user which comprise protective caps in accordance with an embodiment of the invention.
Figure 2:
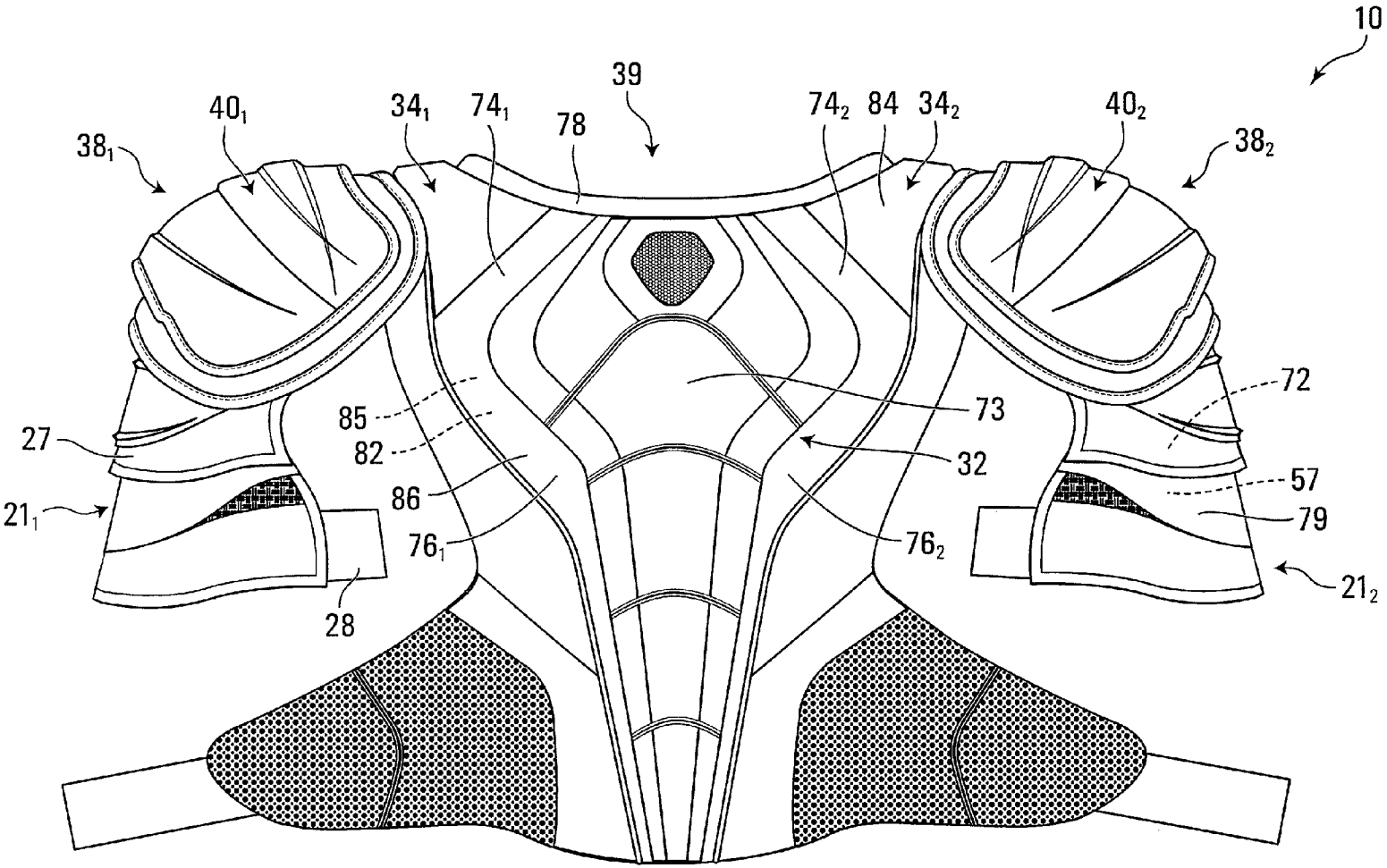
FIG. 2 shows a rear view of the shoulder pads.
Figure 4:
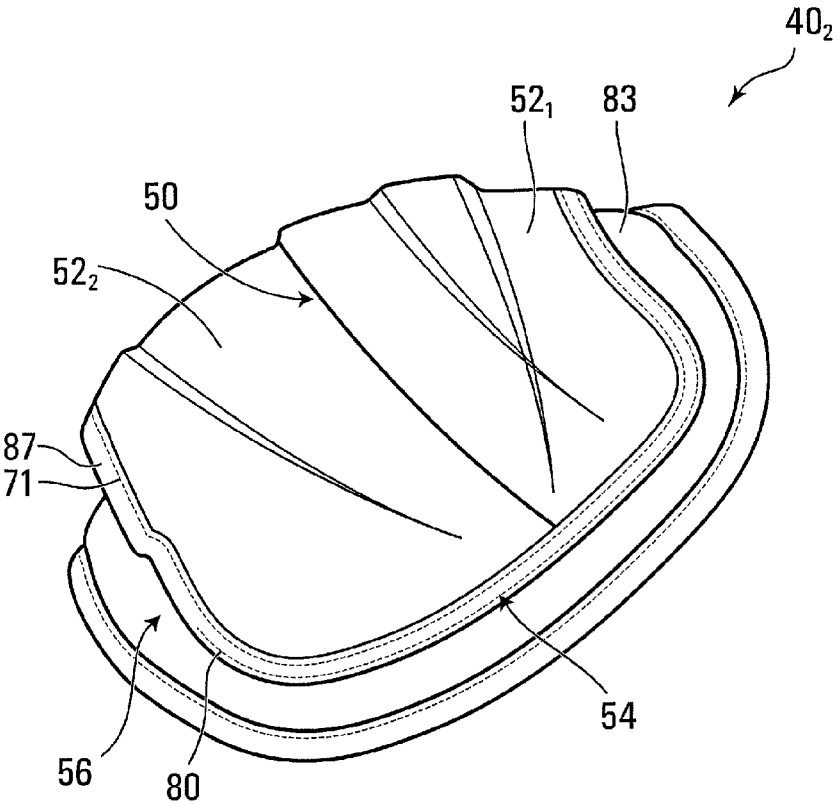
FIG. 4 shows a rear view of the protective cap.
Figure 3:
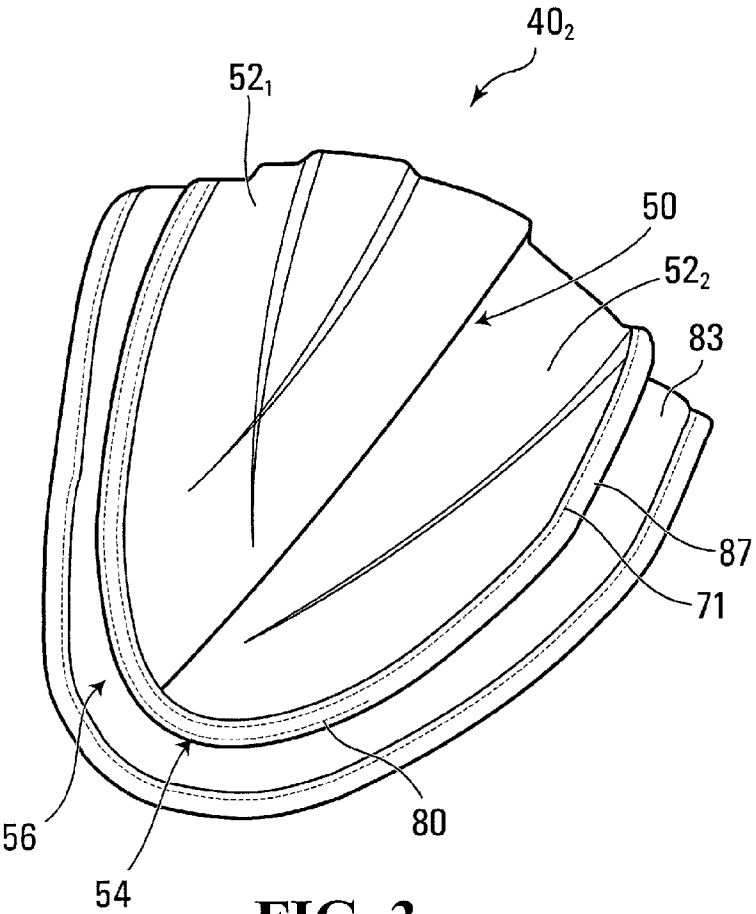
FIG. 3 shows a front view of a protective cap of the shoulder pads.
Figure 5:
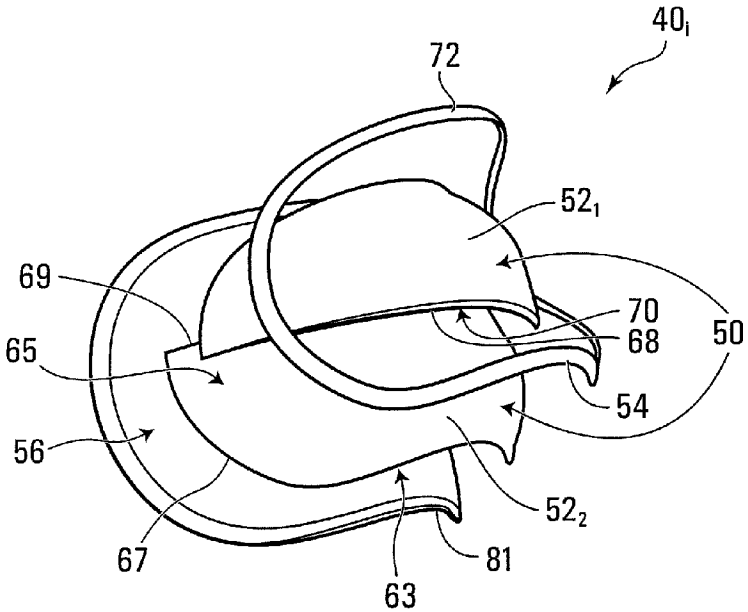
FIG. 5 shows an exploded view of the protective cap.
Figure 6:
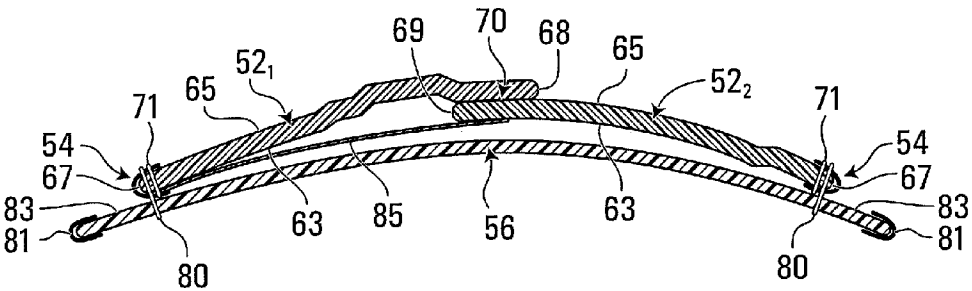
FIG. 6 shows a cross-sectional view of the protective cap.
Figure 7:
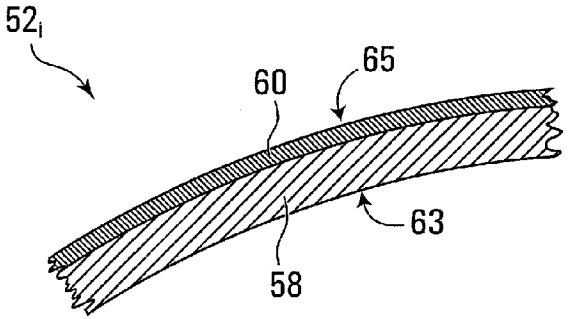
FIG. 7 shows a cross-sectional view of part of a shell member of a shell of the protective cap.
Figure 8:
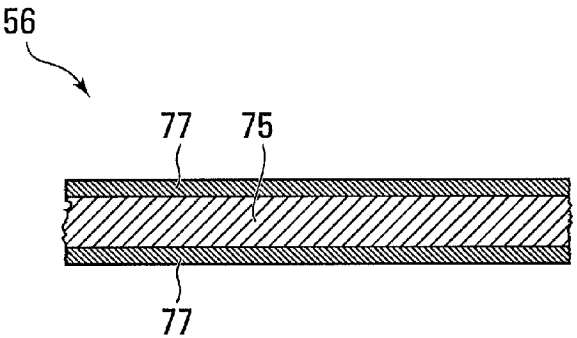
FIG. 8 shows a cross-sectional view of part of a liner of the protective cap.

FIGS. 1 and 2 show an example of a protective athletic garment 10 wearable by a user in accordance with an embodiment of the invention. The protective athletic garment 10 is protective athletic equipment wearable by the user when playing a sport or performing another athletic activity to protect his/her body against injury. In this embodiment, the protective athletic garment 10 is shoulder pads for upper body protection of the user. More particularly, in this embodiment, the user is a hockey player playing hockey such that the shoulder pads 10 are hockey shoulder pads.

Figure 11B:
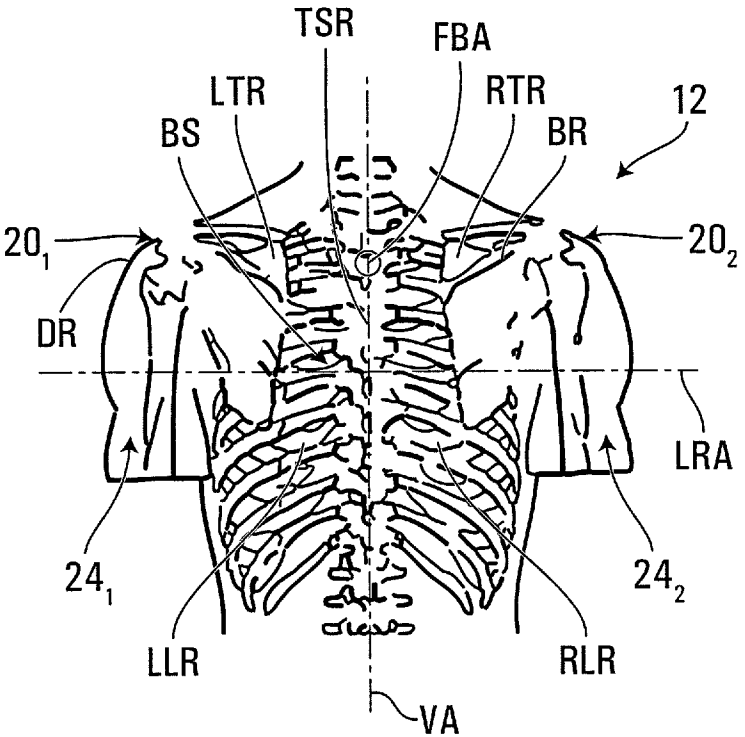
FIGS. 11A and 11B show front and back views of regions of an upper body of the user.
Figure 11A:
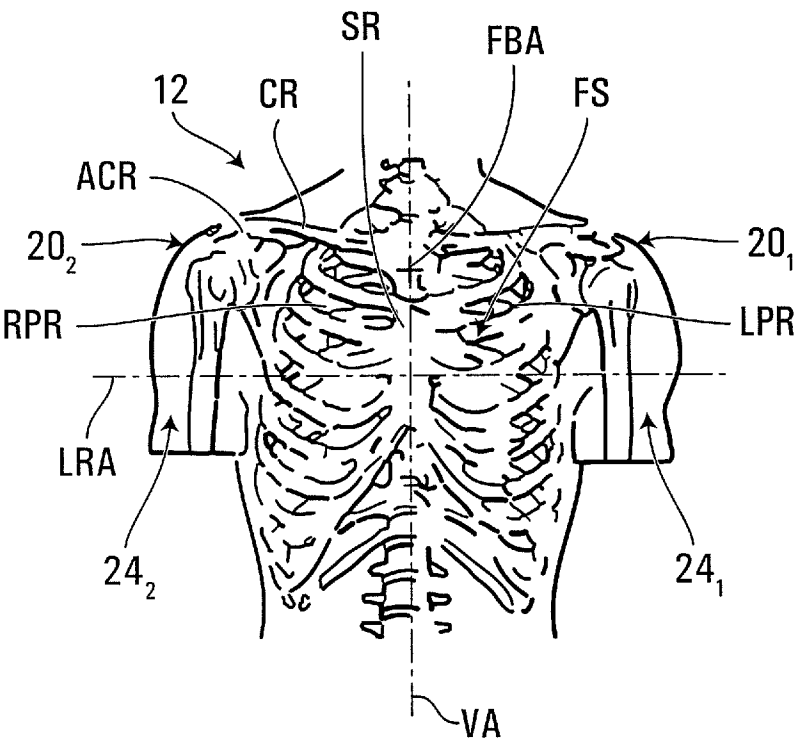

The shoulder pads 10 protect various regions of an upper body of the player. As shown in FIGS. 11A and 11B, a thorax 12 of the player has a front side FS and a back side BS. The front side FS of the thorax 12, which can also be referred to as a "chest" or "ventral" side, comprises left and right pectoral regions LPR, RPR overlying left and right pectoral muscles of the player and a sternum region SR overlying a sternum of the player. The back side BS of the thorax 12, which can also be referred to as a "dorsal" side, comprises a thoracic spinal region TSR overlying thoracic vertebrae of the player, left and right trapezius regions LTR, RTR overlying left and right trapezius muscles of the player, and left and right latissimus dorsi regions LLR, RLR overlying left and right latissimus dorsi muscles of the player. Left and right left shoulders $\mathbf{20}_1$, $\mathbf{20}_2$ of the player join left and right arms $\mathbf{24}_1$, $\mathbf{24}_2$ of the player to the thorax 12. Each of the left and right shoulders $\mathbf{20}_1$, $\mathbf{20}_2$ has a clavicle region CR, a scapular region BR, an acromioclavicular joint region ACR, and a deltoid region DR respectively overlying a clavicle, a scapula, an acromioclavicular joint, and a deltoid muscle of that shoulder. The upper body of the player has a front-back (i.e., a dorso-ventral) axis FBA (which is perpendicular to the front and back views shown in FIGS. 11A and 11B), a left-right (i.e., dextro-sinistral) axis LRA, and a vertical (i.e., cephalo-caudal) axis VA.

The shoulder pads 10 comprise a front portion 30, a back portion 32, left and right shoulder arch portions $\mathbf{34}_1$, $\mathbf{34}_2$, and left and right shoulder protectors $\mathbf{38}_1$, $\mathbf{38}_2$. A front-back direction, a left-right direction, and a top-bottom direction of the shoulder pads 10 are respectively parallel to the front-back axis FBA, the left-right axis LRA, and the vertical axis VA of the upper body of the player. The front portion 30, the back portion 32, and the left and right shoulder arch portions $\mathbf{34}_1$, $\mathbf{34}_2$ define a neck opening 39 for receiving a neck of the player. In this embodiment, the shoulder pads 10 also comprise left and right arm protectors $\mathbf{21}_1$, $\mathbf{21}_2$ and left and right lower straps $\mathbf{44}_1$, $\mathbf{44}_2$.

The left and right shoulder protectors $\mathbf{38}_1$, $\mathbf{38}_2$ comprise protective caps $\mathbf{40}_1$, $\mathbf{40}_2$, which can be referred to as "shoulder caps". As further discussed later, the shoulder caps $\mathbf{40}_1$, $\mathbf{40}_2$ are configured to facilitate movement of the left and right shoulders $\mathbf{20}_1$, $\mathbf{20}_2$ of the player when the player moves his/her left and right arms $\mathbf{24}_1$, $\mathbf{24}_2$.

The front portion 30 is configured to cover at least part of the front side FS of the thorax 12 of the player. In this embodiment, the front portion 30, which can also be referred to as a front "panel", comprises left and right pectoral portions $\mathbf{42}_1$, $\mathbf{42}_2$ for covering the left and right pectoral regions LPR, RPR of the player and a sternum portion 46 for covering the sternum region SR of the player. The front portion 30 comprises a top edge 25 delimiting the neck opening 39.

In this embodiment, the front portion 30 comprises protective padding 48 disposed between an inner liner 51 and an outer covering 55. The protective padding 48 provides padded protection to the left and right pectoral regions LPR, RPR and the sternum region SR of the player. The protective padding 48 may comprise any suitable shock-absorbing material. For instance, in some examples of implementation, the protective padding 48 may comprise foam, such as ethylene vinyl acetate (EVA) foam, expanded polypropylene (EPP) foam, expanded polyethylene (EPE) foam (e.g., low-density polyethylene (LDPE) foam), vinyl nitrile (VN) foam, or any other suitable foam, and/or may comprise shock-absorbing material other than foam (e.g., a gel in the sternum portion 46 for providing added protection to the sternum region SR of the player).

The inner liner 51 faces the thorax 12 of the player and comprises fabric. For instance, in some examples of implementation, the fabric of the inner liner 51 may comprise a woven fabric, a nonwoven fabric, synthetic microfibers, a synthetic woven knit, a polyurethane laminate, a mesh, or any other suitable fabric. The outer covering 55 faces away from the thorax 12 of the player and may comprise any suitable material. For instance, in some examples of implementation, the outer covering 55 may comprise a shell of rigid material (e.g., one or more shell pieces of polycarbonate or other rigid polymeric material) and/or flexible non-foam polymeric material (e.g., polyurethane).

The front portion 30 may be implemented in various other ways in other embodiments. For example, in other embodiments, the front portion 30 may have various other shapes, comprise various other components, and/or be made of various other materials.

The back portion 32 is configured to cover at least part of the back side BS of the thorax 12 of the player. In this embodiment, the back portion 32, which can also be referred to as a back "panel", comprises a spinal portion 73 for covering the thoracic spinal region TSR of the player 14, left and right trapezius portions $\mathbf{74}_1$, $\mathbf{74}_2$ for covering the left and right trapezius regions LTR, RTR of the player, and left and right latissimus dorsi portions $\mathbf{76}_1$, $\mathbf{76}_2$ for covering the left and right latissimus dorsi regions LLR, RLR of the player. The back portion 32 comprises a top edge 78 delimiting the neck opening 39.

In this embodiment, the back portion 32 comprises protective padding 82 disposed between an inner liner 85 and an outer covering 86. The protective padding 82 provides padded protection to the thoracic spinal region SR, the left and right trapezius regions LTR, RTR, and left and right latissimus dorsi regions LLR, RLR of the player. The inner liner 85 faces the thorax 12 of the player, while the outer covering 86 faces away from the thorax 12 of the player. In this example of implementation, these components of the back portion 32 are similar in construction to the protective padding 48, the inner liner 51, and the outer covering 55 of the front portion 30.

The back portion 32 may be implemented in various other ways in other embodiments. For example, in other embodiments, the back portion 32 may have various other shapes, comprise various other components, and/or be made of various other materials.

The left and right shoulder arch portions $\mathbf{34}_1$, $\mathbf{34}_2$ are configured to respectively arch over the left and right shoulders $\mathbf{20}_1$, $\mathbf{20}_2$ of the player and interconnect the front portion 30 and the back portion 32. Each shoulder arch portion $\mathbf{34}_x$ comprises a clavicle portion 53 and a scapular portion 84 for respectively overlying the clavicle region CR and the scapular region BR of the shoulder $\mathbf{20}_x$ over which it arches.

In this embodiment, the shoulder arch portion $\mathbf{34}_x$ comprises protective padding 60 disposed between an inner liner 62 and an outer covering 63. The protective padding 60 provides padded protection to the clavicle region CR and the scapular region BR of the shoulder $\mathbf{20}_x$. The inner liner 62 faces the shoulder $\mathbf{20}_x$, while the outer covering 63 faces away from the shoulder $\mathbf{20}_x$. In this example of implementation, these components of the shoulder arch portion $\mathbf{34}_x$ are similar in construction to the protective padding 48, the inner liner 51, and the outer covering 55 of the front portion 30.

The left and right shoulder arch portions $\mathbf{34}_1$, $\mathbf{34}_2$ may be implemented in various other ways in other embodiments. For example, in other embodiments, each of the left and right shoulder arch portions $\mathbf{34}_1$, $\mathbf{34}_2$ may have various other shapes, comprise various other components, and/or be made of various other materials.

The left and right shoulder protectors $38_1$, $38_2$, which comprise the shoulder caps $40_1$, $40_2$, are configured to respectively cover at least part of the left and right shoulders $20_1$, $20_2$ of the player. In this embodiment, each of the shoulder caps $40_1$, $40_2$ comprises an acromioclavicular joint portion 41 and a deltoid portion 43 for respectively covering at least part of the acromioclavicular joint region ACR and the deltoid region DR of the shoulder it protects.

Each of the left and right shoulder protectors $38_1$, $38_2$ is connected to at least one of the front portion 30, the back portion 32, and a given one of the left and right shoulder arch portions $34_1$, $34_2$. In this embodiment, each shoulder cap $40_x$ is connected to the shoulder arch portion $34_x$ arching over the shoulder $20_x$ that it protects. Also, in this embodiment, the shoulder cap $40_x$ is connected to the arm protector $21_x$ which is on the arm $24_x$ extending from the shoulder $20_x$ it protects. The shoulder cap $40_x$ may be directly connected (e.g., sewed) to the shoulder arch portion $34_x$ and/or the arm protector $21_x$ or may be indirectly connected (e.g., via one or more straps sewed) to the shoulder arch portion $34_x$ and/or the arm protector $21_x$. In this example, the shoulder cap $40_x$ is sewed to the shoulder arch portion $34_x$ and is connected via a strap to the arm protector $21_x$.

The left and right arm protectors $21_1$, $21_2$ are configured to cover at least part of the left and right arms $24_1$, $24_2$ of the player. Each arm protector $21_x$ comprises an outer arm portion 27 for overlying an outer region of the arm $24_x$ it protects and a strap 28 for retaining itself on the arm $24_x$.

In this embodiment, the arm protector $21_x$ comprises protective padding 57 disposed between an inner liner 72 and an outer covering 79. The protective padding 57 provides padded protection to the outer region of the arm $24_x$. The inner liner 72 faces the arm $24_x$, while the outer covering 63 faces away from the arm $24_x$. In this example of implementation, these components of the arm protector $21_x$ are similar in construction to the protective padding 48, the inner liner 51, and the outer covering 55 of the front portion 30.

The left and right arm protectors $21_1$, $21_2$ may be implemented in various other ways in other embodiments. For example, in other embodiments, each of the left and right arm protectors $21_1$, $21_2$ may have various other shapes, comprise various other components, and/or be made of various other materials.

With additional reference to FIGS. 3 to 8, each shoulder cap $40_x$ comprises a shell 50 for overlying the player's shoulder $20_x$ that it protects. The shell 50 comprises a first shell member $52_1$ and a second shell member $52_2$. The shoulder cap $40_x$ also comprises a link 54 interconnecting the shell members $52_1$, $52_2$ to hold the shell members $52_1$, $52_2$ together. The link 54 extends along at least part of a periphery of the first shell member $52_1$ and at least part of a periphery of the second shell member $52_2$ such that the shell members $52_1$, $52_2$ are movable relative to one another in response to movement of the shoulder $20_x$ of the player. The shoulder cap $40_x$ also comprises a liner 56 mounted under the shell 50 to be disposed between the shell 50 and the shoulder $20_x$ of the player. In this embodiment, the shell 50 and the liner 56 are connected to one another through the link 54.

Figure 9B:
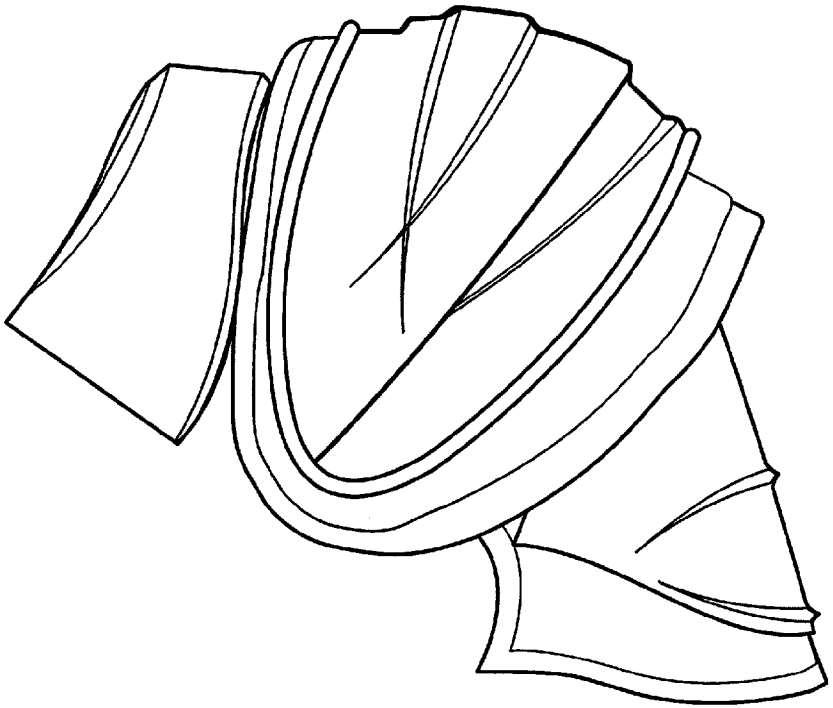
FIGS. 9A and 9B show examples of movement of two shell members of the shell of the protective cap relative to one another.
Figure 9A:
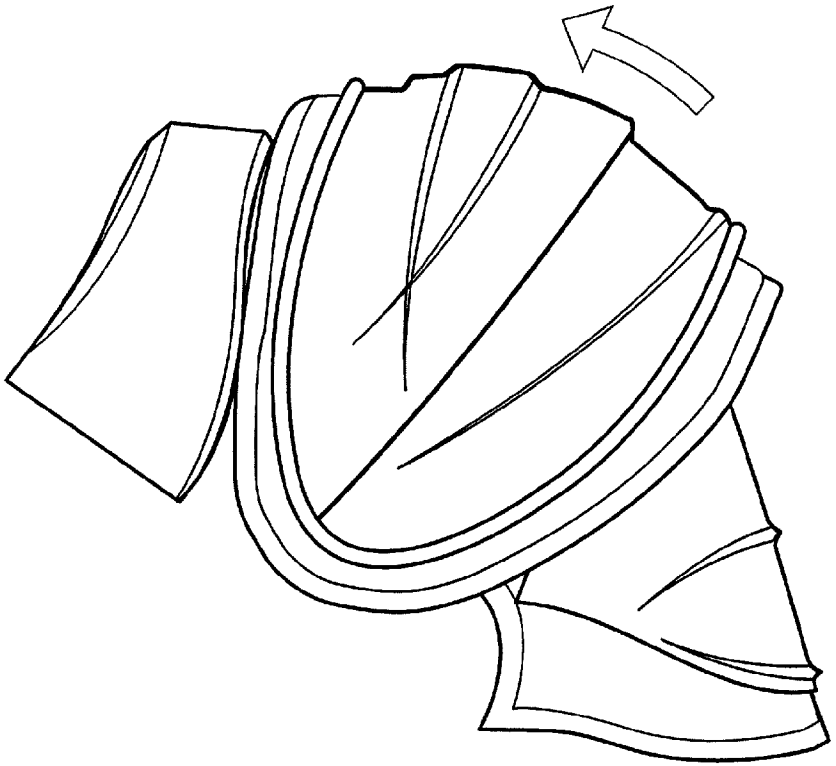

The ability of the shell members $52_1$, $52_2$ to move relative to one another can facilitate movement of the player's shoulder $20_x$ when he/she moves (e.g., raises) his/her arm $24_x$). More particularly, in this embodiment, the second shell member $52_2$ is movable relative to the first shell member $52_1$ between an extended position and a retracted position, examples of which are shown in FIGS. 9A and 9B. When the second shell member $52_2$ is in the retraction position (FIG. 9B), the shell members $52_1$, $52_2$ overlap. When the second shell member $52_2$ is in the extended position (FIG. 9A), the shell members $52_1$, $52_2$ are positioned relative to one another to avoid a gap therebetween through which the shoulder $20_x$ of the player could be impacted. In this example of implementation, the shell members $52_1$, $52_2$ overlap when the second shell member $52_2$ is in the extended position. An overlap of the shell members $52_1$, $52_2$ when the second shell member $52_2$ is in the retracted position, as shown in FIG. 9B, is greater than an overlap of the shell members $52_1$, $52_2$ when the second shell member $52_2$ is in the extended position, as shown in FIG. 9A. The overlap of the shell members $52_1$, $52_2$ in each of the retracted position and the extended position can be taken as a distance between a portion 68 of the peripheral edge 67 of the first shell member $52_1$ that overlaps the second shell member $52_2$ and a portion 69 of the peripheral edge 67 of the second shell member $52_2$ that overlaps the first shell member $52_1$ measured along a direction of motion of the second shell member $52_2$ relative to the first shell member $52_1$. For example, in some embodiments, the overlap of the shell members $52_1$, $52_2$ when the second shell member $52_2$ is in the retracted position (FIG. 7B) may be at least 10%, in some cases at least 20%, and in some cases at least 30% or more (e.g., 50%) greater than the overlap of the shell members $52_1$, $52_2$ when the second shell member $52_2$ is in the extended position. In other examples of implementation, the shell members $52_1$, $52_2$ may not overlap when the second shell member $52_2$ is in the extended position, but may rather be close enough to avoid a gap therebetween that would expose the player's shoulder $20_x$ to an impact though such gap.

Therefore, in this embodiment, when the player's shoulder $20_x$ moves as the player's arm $24_x$ moves upwardly, the second shell member $52_2$ can pivot medially (i.e., in a direction towards a medial (midsagittal) plane of the player's body) relative to the first shell member $52_1$. This is represented by an arrow in FIG. 9A indicating a direction of movement of the second shell member $52_2$ relative to the first shell member $52_1$ such that the second shell member $52_2$ moves from the extended position shown in FIG. 9A towards the retracted position shown in FIG. 9B. Conversely, when the player's shoulder $20_x$ moves as the player's arm $24_x$ moves downwardly, the second shell member $12_2$ can pivot laterally (i.e., in a direction away from the medial (midsagittal) plane of the player's body) relative to the first shell member $12_1$. This would be a movement of the second shell member $52_2$ in a direction opposite to the arrow in FIG. 9A.

Accordingly, while the rigidity of the shell 50 of the shoulder cap $40_x$ provides proper protection of the player's shoulder $20_x$, the ability of the shell members $52_1$, $52_2$ to move relative to one another facilitates movement of the player's shoulder $20_x$.

Each shell member $52_i$ of the shell 50 of the shoulder cap $40_x$ is rigid and has an inner side 63 facing towards the shoulder $20_x$, an outer side 65 opposite the inner side 63 and facing away from the shoulder $20_x$, and a peripheral edge 67 between the inner side 63 and the outer side 65. In this example of implementation, the shell member $52_i$ is curved such that its inner and outer sides 63, 65 are curved. More particularly, in this example, the shell member $52_i$ is curved in two orthogonal directions such that its inner side 63 is generally concave and its outer side 65 is generally convex.

In this embodiment, the shell member $52_i$ comprises a rigid core 58 and a fabric layer 60 covering at least part of the rigid core 58. More particularly, in this embodiment, the fabric layer 60 overlies an outer surface of the rigid core 58 such that it forms at least part of the outer side 65 of the shell member $52_i$. The rigid core 58 and the fabric layer 60 may be made of any suitable material. For example, in some embodiments, the rigid core 58 may comprise polycarbonate, high-density polyethylene (HDPE), polypropylene, polyurethane, or any other rigid polymeric material or any other suitably rigid material. The fabric layer 60 may comprise a woven fabric (e.g., a woven polyester or nylon fabric), a nonwoven fabric, synthetic microfibers, a synthetic woven knit, a polyurethane laminate, a mesh, or any other suitable fabric.

Figure 10:
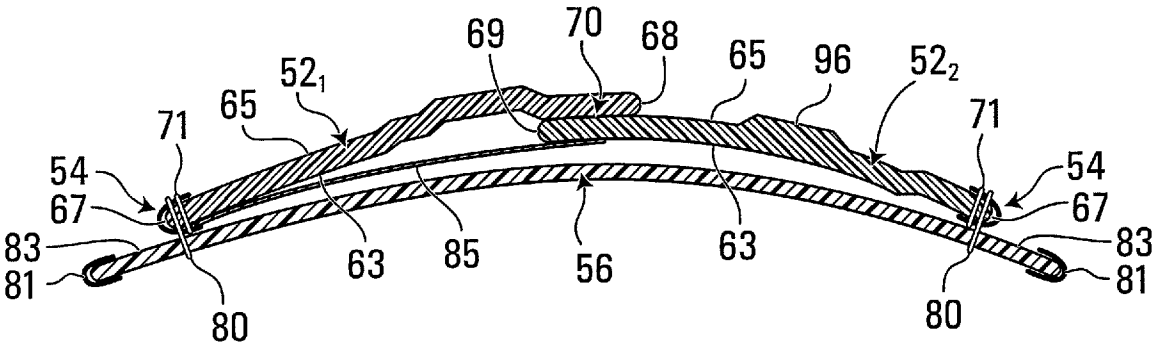
FIG. 10 shows a cross-sectional view of part of a shell member of a shell of the protective cap in accordance with another embodiment of the invention.

The shell 50 may be implemented in various other ways in other embodiments. For example, in other embodiments, the shell members $\mathbf{52}_1$, $\mathbf{52}_2$ may have various other shapes and/or be made of various other materials. For instance, FIG. 10 illustrates another embodiment in which the shell member $\mathbf{52}_2$ includes a projection 96 which can be engaged by the shell member $\mathbf{52}_1$ as the shell members $\mathbf{52}_1$, $\mathbf{52}_2$ move relative to one another to limit this relative movement.

The link 54 may extend along any suitable extent of the shell 50 to interconnect and hold together the shell members $\mathbf{52}_1$, $\mathbf{52}_2$. In this embodiment, the link 54 extends along at least a majority of a perimeter of the shell 50. More particularly, in this embodiment, the link 54 extends along an entirety of the perimeter of the shell 50 such that it surrounds the shell 50. Also, in this embodiment, the link 54 overlies the inner side 63, the outer side 65 and the peripheral edge 67 of the first shell member $\mathbf{52}_1$ and the inner side 63, the outer side 65 and the peripheral edge 67 of the second shell member $\mathbf{52}_2$.

In this example of implementation, the link 54 extends along a majority of the peripheral edge 67 of the first shell member $\mathbf{52}_1$ and a majority of the peripheral edge 67 of the second shell member $\mathbf{52}_2$. More particularly, in this example, the link 54 extends along all the peripheral edge 67 of the first shell member $\mathbf{52}_1$ except along a portion 68 of the peripheral edge 67 of the first shell member $\mathbf{52}_1$ that overlaps the second shell member $\mathbf{52}_2$ when the second shell member $\mathbf{52}_2$ is in the retracted position. Similarly, the link 54 extends along all the peripheral edge 67 of the second shell member $\mathbf{52}_2$ except along a portion 69 of the peripheral edge 67 of the second shell member $\mathbf{52}_2$ that overlaps the first shell member $\mathbf{52}_1$ when the second shell member $\mathbf{52}_2$ is in the retracted position. In other words, each of the portion 68 of the peripheral edge 67 of the first shell member $\mathbf{52}_1$ and the portion 69 of the peripheral edge 67 of the second shell member $\mathbf{52}_2$ is free of the link 54. This creates a space 70 between the shell members $\mathbf{52}_1$, $\mathbf{52}_2$ allowing them to move relative to another when the shoulder $\mathbf{20}_x$ of the player moves.

In this embodiment, the link 54 comprises a connecting band 72. More particularly, in this embodiment, the connecting band 72 is a connecting strip of fabric. In this example, the strip of fabric constituting the connecting band 72 is a braiding. For instance, in some examples of implementation, the strip of fabric constituting the connecting band 72 may comprise a woven polyester fabric, a woven nylon fabric, or any other suitable textile. The connecting band 72 may be made of any other suitable material in other examples of implementation (e.g., polyurethane, rubber or another elastomer, spandex, etc.).

The link 54 can be affixed to the shell members $\mathbf{52}_1$, $\mathbf{52}_2$ in various ways. In this embodiment, the link 54 is affixed to the shell members $\mathbf{52}_1$, $\mathbf{52}_2$ by a stitching 71. More particularly, the stitching 71 extends through the link 54 and each shell member $\mathbf{52}_i$ to affix the link 54 to the shell member $\mathbf{52}_i$. The stitching 71 may extend along a majority of the perimeter of the shell 50. In this example, the stitching 71 surrounds the shell 50. In other embodiments, the link 54 may be affixed to the shell members $\mathbf{52}_1$, $\mathbf{52}_2$ by staples, an adhesive, or any other suitable affixing means.

The link 54 may be implemented in various other ways in other embodiments. For example, in other embodiments, the link 54 may have various other shapes and/or be made of various other materials.

The liner 56 is flexible. In this embodiment, the liner 56 comprises a flexible core 75 and a fabric layer 77 covering at least part of the flexible core 75. More particularly, in this embodiment, the fabric layer 77 overlies inner and outer surfaces of the flexible core 75. The flexible core 75 and the fabric layer 77 may be made of any suitable material. For example, in some embodiments, the flexible core 75 may comprise foam, such as low-density polyethylene (LDPE) foam, polyurethane foam, EVA foam, VN foam, or any other suitable foam. The fabric layer 77 may comprise a woven fabric (e.g., a woven polyester or nylon fabric), a nonwoven fabric, synthetic microfibers, a synthetic woven knit, a polyurethane laminate, a mesh, or any other suitable fabric. In this embodiment, the liner 56 also comprises a braiding 81 along its periphery.

A perimeter of the liner 56 is at least as large as the perimeter of the shell 50. In this embodiment, the perimeter of the liner 56 is larger than the perimeter of the shell 50. More particularly, in this embodiment, the shell 50 is disposed generally concentrically on the liner 56. The perimeter of the shell 50 is disposed within the perimeter of the liner 56 such that the liner 56 includes a margin 83 that is left exposed.

In this example, the liner 56 is connected to the shoulder arch portion $\mathbf{34}_x$ and the arm protector $\mathbf{21}_x$, directly or indirectly, in order to connect the shoulder cap $\mathbf{40}_x$ to the shoulder arch portion $\mathbf{34}_x$ and the arm protector $\mathbf{21}_x$. More particularly, in this example, the liner 56 is sewed to the shoulder arch portion $\mathbf{34}_x$ and is connected to the arm protector $\mathbf{21}_x$ via a strap which is sewed to the liner 56, the shoulder arch portion $\mathbf{34}_x$ and the arm protector $\mathbf{21}_x$.

The liner 56 may be implemented in various other ways in other embodiments. For example, in other embodiments, the liner 56 may have various other shapes and/or be made of various other materials.

The shell 50 can be affixed to the liner 56 in various ways. In this embodiment, the shell 50 is affixed to the liner 56 by a stitching 80. In this example, the stitching 80 extends through the link 54 which interconnects the shell members $\mathbf{52}_1$, $\mathbf{52}_2$ and through the liner 56. The stitching 80 may extend along all or less than all of the perimeter of the shell 50. In this example, the stitching 80 extends along all of a proximal side, a front side and a back side of the perimeter of the shell 50 and along part but not all of a distal side of the perimeter of the shell 50 such that a portion 87 of the perimeter of the shell 50 is free from attachment to the liner 56. In other embodiments, the shell 50 may be affixed to the liner 56 by the stitching 78 which fixes the link 54 to the shell members $\mathbf{52}_1$, $\mathbf{52}_2$. In other words, the stitching 78 may extend through the shell members $\mathbf{52}_1$, $\mathbf{52}_2$, the link 54 and the liner 56. In other embodiments, the shell 50 may be affixed to the liner 56 by staples, an adhesive, or any other suitable affixing means.

Flexibility of the liner 56 may facilitate motion of the shell members $\mathbf{52}_1$, $\mathbf{52}_2$ relative to one another since the shell 50 and the liner 56 are interconnected through the link 54 in this embodiment. For example, in this embodiment, when the shell member $\mathbf{52}_2$ moves relative to the shell member $\mathbf{52}_1$ towards its retracted position, a portion of the liner 56 through which extends a portion of the stitching 80 that also extends through the shell member $\mathbf{52}_2$ may bend towards the shell member $\mathbf{52}_1$ to facilitate motion of the shell member $\mathbf{52}_2$. Conversely, when the shell member $\mathbf{52}_2$ moves relative to the shell member $\mathbf{52}_1$ towards its extended position, the portion of the liner 56 through which extends the portion of the stitching

80 that also extends through the shell member $\mathbf{52}_2$ may bend away from the shell member $\mathbf{52}_1$ to facilitate motion of the shell member $\mathbf{52}_2$.

In this embodiment, the shoulder cap $\mathbf{40}_x$ comprises a restraint 85 interconnecting the shell members $\mathbf{52}_1$, $\mathbf{52}_2$ to restrain movement of the second shell member $\mathbf{52}_2$ relative to the first shell member $\mathbf{52}_1$. In this example of implementation, the restraint 85 is implemented as a tether which is a strap that is connected (e.g., sewed) to the shell members $\mathbf{52}_1$, $\mathbf{52}_2$ on their respective inner side 63.

More particularly, in this embodiment, the restraint 85 is configured to prevent the second shell member $\mathbf{52}_2$ from moving from a given one of the inner side 63 and the outer side 65 of the first shell member $\mathbf{52}_1$ to an opposite one of the inner side 63 and the outer side 65 of the first shell member $\mathbf{52}_1$, in this case from the inner side 63 to the outer side 65 of the first shell member $\mathbf{52}_1$. The restraint 85 prevents the peripheral edge 67 of the second shell member $\mathbf{52}_2$ to move over the peripheral edge 67 of the first shell member $\mathbf{52}_1$ and onto the outer side 65 of the first shell member $\mathbf{52}_1$ when the second shell member $\mathbf{52}_2$ pivots laterally (i.e., in a direction away from the medial (midsagittal) plane of the player's body).

The restraint 85 may be implemented in various other ways in other embodiments. For example, in other embodiments, the restraint 85 may have various other shapes and/or be made of various other materials.

The shoulder caps $\mathbf{40}_1$, $\mathbf{40}_2$ may be implemented in various other ways in other embodiments. For example, in other embodiments, each of the shoulder caps $\mathbf{40}_1$, $\mathbf{40}_2$ may have various other shapes, comprise various other components, and/or be made of various other materials.

While in this embodiment the shoulder pads 10 are hockey shoulder pads, in other embodiments, shoulder pads constructed using principles described herein in respect of the shoulder pads 10, including the protective caps $\mathbf{40}_1$, $\mathbf{40}_2$, may be another type of shoulder pads for upper body protection of a player playing another type of contact sport (sometimes referred to as "full-contact sport" or "collision sport") in which there are significant impact forces on the player due to player-to-player and/or player-to-object contact. For example, in other embodiments, shoulder pads constructed using principles described herein in respect of the shoulder pads 10 may be lacrosse shoulder pads for upper body protection of a lacrosse player. As another example, in other embodiments, shoulder pads constructed using principles described herein in respect of the shoulder pads 10 may be football shoulder pads for upper body protection of a football player.

Although in embodiments considered above the shoulder pads 10 are a protective athletic garment for a user playing a contact sport, a protective athletic garment constructed using principles described herein in respect of the shoulder pads 10, including the protective caps $\mathbf{40}_1$, $\mathbf{40}_2$, may be used in athletic activities other than contact sports in which protection against body injury is desired.

While in this embodiment the protective caps $\mathbf{40}_1$, $\mathbf{40}_2$ are part of shoulder pads, a protective cap constructed using principles described herein in respect of the protective caps $\mathbf{40}_1$, $\mathbf{40}_2$ may be used in other types of protective athletic garments. For example, in other embodiments, a protective cap constructed using principles described herein in respect of the protective caps $\mathbf{40}_1$, $\mathbf{40}_2$ may be a knee cap of a leg pad or an elbow cap of an elbow pad worn by a user in order to protect a knee or an elbow of the user. A protective cap constructed using principles described herein in respect of the protective caps $\mathbf{40}_1$, $\mathbf{40}_2$ may be used to protect any articulation of the user while facilitating movement of that articulation.

To facilitate the description, any reference numeral designating an element in one figure has been used to designate the same element if used in any other figures. In describing the embodiments, specific terminology has been resorted to for the sake of clarity but the invention is not intended to be limited to the specific terms so selected, and it is understood that each specific term comprises all equivalents.

Unless otherwise indicated, the drawings are intended to be read together with the specification, and are to be considered a portion of the entire written description of this invention. Unless otherwise indicated, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure.

Although various embodiments and examples have been presented, this was for the purpose of describing, but not limiting, the invention. Various modifications and enhancements will become apparent to those of ordinary skill in the art and are within the scope of the invention, which is defined by the appended claims.

The invention claimed is:

1. A protective athletic garment wearable by a user, the protective athletic garment comprising a protective cap for protecting a body part comprising an articulation of the user, the protective cap comprising:

a) a shell for overlying the user's articulation, the shell comprising a first shell member and a second shell member that are disposed to overlie the user's articulation;

b) a liner mounted under the shell for being disposed between the shell and the user's articulation; and c) a link interconnecting the first shell member and the second shell member to hold the first shell member and the second shell member together, the link extending along at least part of a periphery of the first shell member and at least part of a periphery of the second shell member such that the first shell member and the second shell member are movable relative to one another and relative to the liner in response to movement of the user's articulation.

2. The protective athletic garment of claim 1, wherein the second shell member is movable relative to the first shell member between an extended position and a retracted position, the first shell member and the second shell member overlapping when the second shell member is in the retracted position.

3. The protective athletic garment of claim 2, wherein, when the second shell member is in the extended position, the first shell member and the second shell member are positioned to prevent a gap therebetween through which the user's articulation could be impacted.

4. The protective athletic garment of claim 2, wherein the first shell member and the second shell member overlap when the second shell member is in the extended position, an overlap of the first shell member and the second shell member when the second shell member is in the retracted position being greater than an overlap of the first shell member and the second shell member when the second shell member is in the extended position.

5. The protective athletic garment of claim 1, wherein the link comprises a strip of fabric.

6. The protective athletic garment of claim 5, wherein the strip of fabric is a braiding.

7. The protective athletic garment of claim 1, wherein the link extends along at least a majority of a perimeter of the shell.

8. The protective athletic garment of claim 1, wherein the link surrounds the shell.

9. The protective athletic garment of claim 1, wherein each of the first shell member and the second shell member comprises an inner side for facing towards the user's articulation and an outer side for facing away from the user's articulation and wherein the liner is spaced apart from the inner side of the first shell member and the inner side of the second shell member.

10. The protective athletic garment of claim 9, wherein each of the first shell. member and the second shell member comprises a peripheral edge defined between its inner side and its outer side and wherein the link covers the inner side, the outer side and the peripheral edge of the first shell member and covers the inner side, the outer side and the peripheral edge of the second shell member.

11. The protective athletic garment of claim 9, wherein each of the first and second shell members is curved in two orthogonal directions such that its inner side is generally concave and its outer side is generally convex.

12. The protective athletic garment of claim 11, wherein the shell has a dome shape.

13. The protective athletic garment of claim 1, wherein the link is affixed to the shell and the liner.

14. The protective athletic garment of claim 13, wherein the link is affixed to the shell and the liner by at least one stitching.

15. The protective athletic garment of claim 1, wherein the shell is affixed to the liner by a stitching passing through the link.

16. The protective athletic garment of claim 15, wherein the link and the stitching surround the shell.

17. The protective athletic garment of claim 15, wherein the stitching is a first stitching, the link being affixed to the shell by a second stitching.

18. The protective athletic garment of claim 1, wherein each of the first shell member and the second shell member comprises a rigid core and a fabric layer covering at least part of the rigid core.

19. The protective athletic garment of claim 1, wherein the liner comprises a flexible core and a fabric layer covering at least part of the flexible core.

20. The protective athletic garment of claim 1, comprising a restraint interconnecting the first shell member and the second shell member to restrain movement of the second shell member relative to the first shell member.

21. The protective athletic garment of claim 1, wherein a perimeter of the liner is larger than a perimeter of the shell.

22. The protective athletic garment of claim 1, wherein the articulation is located proximate a joint region of a shoulder, a knee cap or an elbow point and wherein the protective cap is a shoulder cap, knee cap or elbow cap with first and second shell members overlying the joint region of the shoulder, knee cap or elbow point.

23. The protective athletic garment of claim 2, wherein a portion of a peripheral edge of the first shell member overlaps a portion of a peripheral edge of the second shell member when the second shell member is in the extended or retracted position, the overlapping peripheral edge portions being free of the link.

24. A protective athletic garment wearable by a user, the protective athletic garment comprising a protective cap for protecting a body part comprising an articulation of the user, the protective cap comprising:

a) a shell for overlying the user's articulation, the shell comprising a first shell member and a second shell member, wherein each of the first shell member and the second shell member comprises an inner side for facing towards the user's articulation, an outer side opposite the inner side and for facing away from the user's articulation, and a peripheral edge defined between the inner side and the outer side;

b) a liner mounted under the shell for being disposed between the shell and the user's articulation; and c) a band interconnecting the first shell member and the second shell member to hold the first shell member and the second shell member together, the band extending along at least part of a periphery of the first shell member and at least part of a periphery of the second shell member such that the first shell member and the second shell member are movable relative to one another in response to movement of the user's articulation, and wherein the band covers the inner side, the outer side and the peripheral edge of the first shell member and covers the inner side, the outer side and the peripheral edge of the second shell member.

25. The protective athletic garment of claim 24, wherein the second shell member is movable relative to the first shell member between an extended position and a retracted position, the first shell member and the second shell member overlapping when the second shell member is in the retracted position.

26. The protective athletic garment of claim 25, wherein, when the second shell member is in the extended position, the first shell member and the second shell member are positioned to prevent a gap therebetween through which the user's articulation could be impacted.

27. The protective athletic garment of claim 25, wherein the first shell member and the second shell member overlap when the second shell member is in the extended position, an overlap of the first shell member and the second shell member when the second shell member is in the retracted position being greater than an overlap of the first shell member and the second shell member when the second shell member is in the extended position.

28. The protective athletic garment of claim 24, wherein the hand extends along at least a majority of a perimeter of the shell.

29. The protective athletic garment of claim 24, wherein the band surrounds the shell.

30. The protective athletic garment of claim 24, wherein the liner is spaced apart from at least part of the inner side of the first shell member and at least part of the inner side of the second shell member.

31. The protective athletic garment of claim 24, wherein the articulation is located proximate a joint region of a shoulder, a knee cap or an elbow point and wherein the protective cap is a shoulder cap, knee cap or elbow cap with first and second shell members overlying the joint region of the shoulder, knee cap or elbow point.

32. The protective athletic garment of claim 25, wherein a portion of a peripheral edge of the first shell member overlaps a portion of a peripheral edge of the second shell member when the second shell member is in the extended or retracted position, the overlapping peripheral edge portions being free of the link.

33. The protective athletic garment of claim 24, wherein the first shell member and the second shell member are movable relative to the liner in response to movement of the user's articulation.

34. Athletic shoulder pads wearable by a user, the athletic shoulder pads comprising:

a) a front portion for covering at least part of a front side of a thorax of the user;

b) a back portion for covering at least part of a back side of the thorax of the user;

c) left and right shoulder arch portions for respectively arching over left and right shoulders of the user and interconnecting the front portion. and said back portion;

e) left and right shoulder caps mounted above the left and right shoulder arch. portions for respectively protecting the left and right shoulders of the player, each of the left and right shoulder caps comprising:

i. a shell for overlying a respective one of the left and right shoulders of the user, the shell comprising a first shell member and a second shell member that are disposed to overlie the respective one of the left and right shoulders of the user;

ii. a liner mounted under the shell for being disposed between the shell and the respective one of the left and right shoulders of the user; and iii. a link interconnecting the first shell member and the second shell member to hold the first shell member and the second shell member together, the link extending along at least part of a periphery of the first shell member and at least part of a periphery of the second shell member such that the first shell member and the second shell member are movable relative to one another in response to movement of the respective one of the left and right shoulders of the user.

* * * * *

UNITED STATES PATENT AND TRADEMARK OFFICE

CERTIFICATE OF CORRECTION

PATENT NO. : 8,869,315 B2
APPLICATION NO. : 13/475441
DATED : October 28, 2014
INVENTOR(S) : Mathieu Contant et al.

It is certified that error appears in the above-identified patent and that said Letters Patent is hereby corrected as shown below:

In the Claims

Col. 11, Line 14, remove the "." after the word "shell";

Col. 12, Line 44, the word "hand" should read "band";

Col. 13, Line 9, remove the "." after the word "portion";

Col. 13, Line 11, remove the "." after the word "arch".

Signed and Sealed this
Twenty-fourth Day of February, 2015

Michelle K. Lee

Michelle K. Lee
*Deputy Director of the United States Patent and Trademark Office*